US011262061B2

(12) United States Patent
Kitamura

(10) Patent No.: US 11,262,061 B2
(45) Date of Patent: Mar. 1, 2022

(54) STORAGE CASE

(71) Applicant: Sony Olympus Medical Solutions Inc., Tokyo (JP)

(72) Inventor: Ken Kitamura, Tokyo (JP)

(73) Assignee: SONY OLYMPUS MEDICAL SOLUTIONS INC., Tokyo (JP)

( * ) Notice: Subject to any disclaimer, the term of this patent is extended or adjusted under 35 U.S.C. 154(b) by 0 days.

(21) Appl. No.: 17/149,734

(22) Filed: Jan. 15, 2021

(65) Prior Publication Data

US 2021/0278070 A1 Sep. 9, 2021

(30) Foreign Application Priority Data

Mar. 5, 2020 (JP) ..... JP2020-038271

(51) Int. Cl.
*F21V 23/06* (2006.01)
*F21V 15/01* (2006.01)
*F21V 23/00* (2015.01)

(52) U.S. Cl.
CPC ..... *F21V 23/06* (2013.01); *F21V 15/01* (2013.01); *F21V 23/003* (2013.01)

(58) Field of Classification Search
CPC ..... F21V 23/06; F21V 23/003; F21V 15/01
USPC ..... 362/640
See application file for complete search history.

(56) References Cited

U.S. PATENT DOCUMENTS 5,253,152 A * 10/1993 Yang ..... F21S 8/02 362/221
2004/0141320 A1* 7/2004 Bock ..... G01N 21/87 362/253
2009/0185359 A1* 7/2009 Martinez ..... F21L 4/08 362/20
2009/0207620 A1* 8/2009 Nakayama ..... F21V 29/83 362/311.02
2011/0249427 A1* 10/2011 Rooms ..... F21S 8/026 362/147
2018/0135811 A1* 5/2018 Soni ..... F21V 19/0015
2019/0000242 A1* 1/2019 Didur ..... A47F 3/001
2019/0137056 A1* 5/2019 Sreshta ..... F21V 23/0435

* cited by examiner

*Primary Examiner* — Bryon T Gyllstrom
(74) *Attorney, Agent, or Firm* — Xsensus LLP

(57) ABSTRACT

A storage case includes: a casing having an opening bottom and configured to internally store a functional unit electrically connected to perform a function; a power supply configured to supply power to the functional unit; a drive module including a drive board arranged on an upper surface or side surface of the casing and configured to drive the functional unit; a connector configured to electrically connect the power supply and the drive module; and a restriction member configured to restrict movement of the casing, wherein the drive board is arranged on a surface in a removal direction of the casing, and a connection/disconnection direction of the connector is different from the removal direction of the casing.

19 Claims, 7 Drawing Sheets

STORAGE CASE

CROSS-REFERENCE TO RELATED APPLICATION

This application claims priority from Japanese Application No. 2020-038271, filed on Mar. 5, 2020, the contents of which are incorporated by reference herein in its entirety.

BACKGROUND

The present disclosure relates to a storage case that stores a functional unit such as a light source.

In a medical field or industrial field, endoscope devices that observes inside subjects such as persons or machine structures have been widely used. Such an endoscope generally includes an illuminating unit that emits illumination light, but in some cases, a light source needs to be replaced due to aged deterioration or the like. In addition, it is known that it is dangerous to directly look at the light source when the light source is emitting light.

In order to replace the light source, for example, a back surface or the like of a casing storing the light source is removed before removing the light source (see, for example, JP 2006-64787 A), but a connector connected to an external power supply is provided separately from a back surface plate of the casing, and thereby, in some cases, the back surface of the casing is removed by mistake while the light source is emitting light without stopping power supply to the light source.

SUMMARY

There is a need for a storage case that enables safe replacement of a functional unit, such as a light source, being stored.

According to one aspect of the present disclosure, there is provided a storage case including: a casing having an opening bottom and configured to internally store a functional unit electrically connected to perform a function; a power supply configured to supply power to the functional unit; a drive module including a drive board arranged on an upper surface or side surface of the casing and configured to drive the functional unit; a connector configured to electrically connect the power supply and the drive module; and a restriction member configured to restrict movement of the casing, wherein the drive board is arranged on a surface in a removal direction of the casing, and a connection/disconnection direction of the connector is different from the removal direction of the casing.

DETAILED DESCRIPTION

Figure 1:
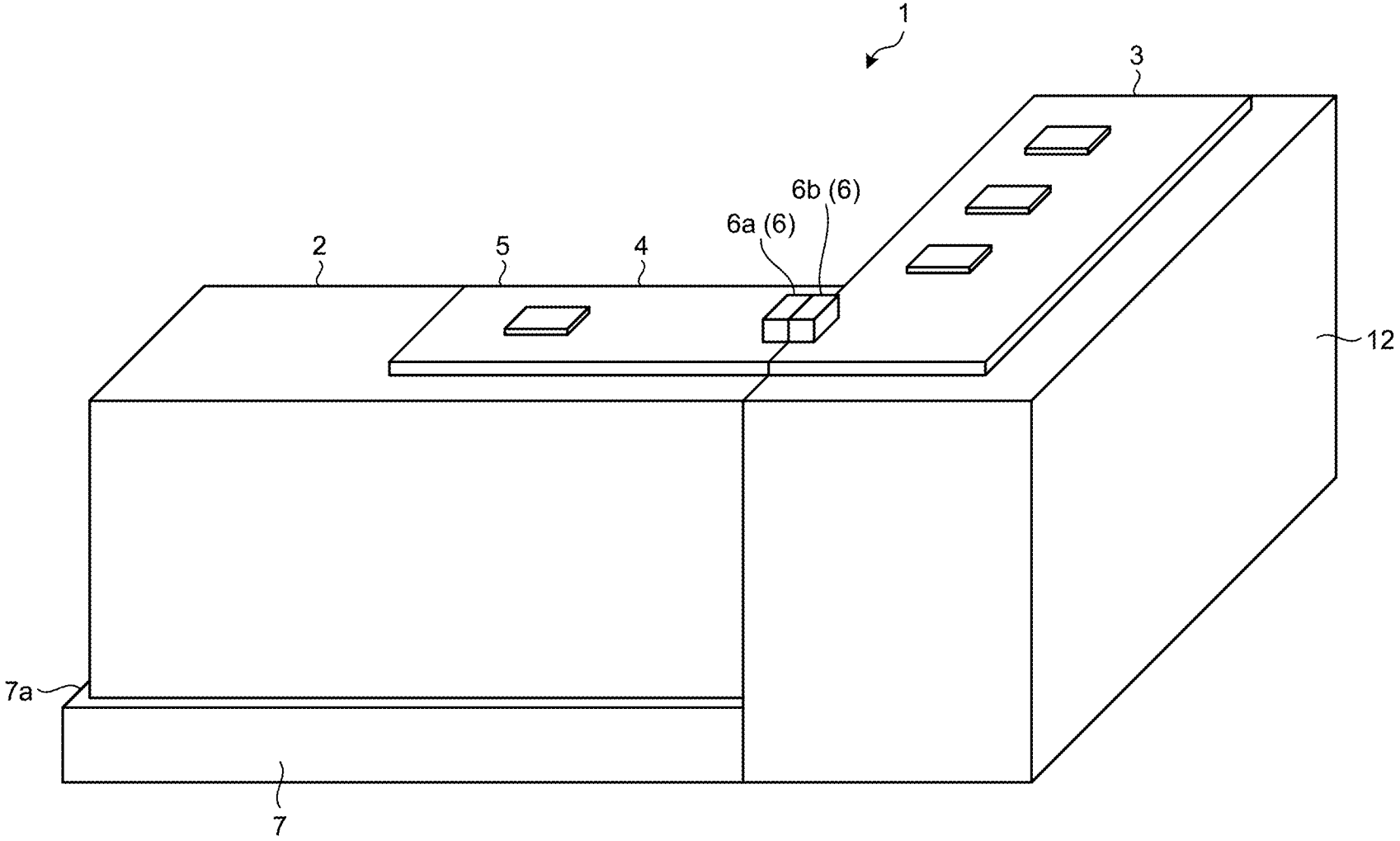
FIG. 1 is a perspective view illustrating a schematic configuration of a storage case according to a first embodiment.

Embodiments for carrying out the present disclosure (hereinafter referred to as "embodiments") will be described below with reference to the drawings. It should be noted that the present disclosure is not limited to the embodiments described below. Furthermore, in the drawings, like reference numerals are used to denote like parts.

First Embodiment

Figure 2:
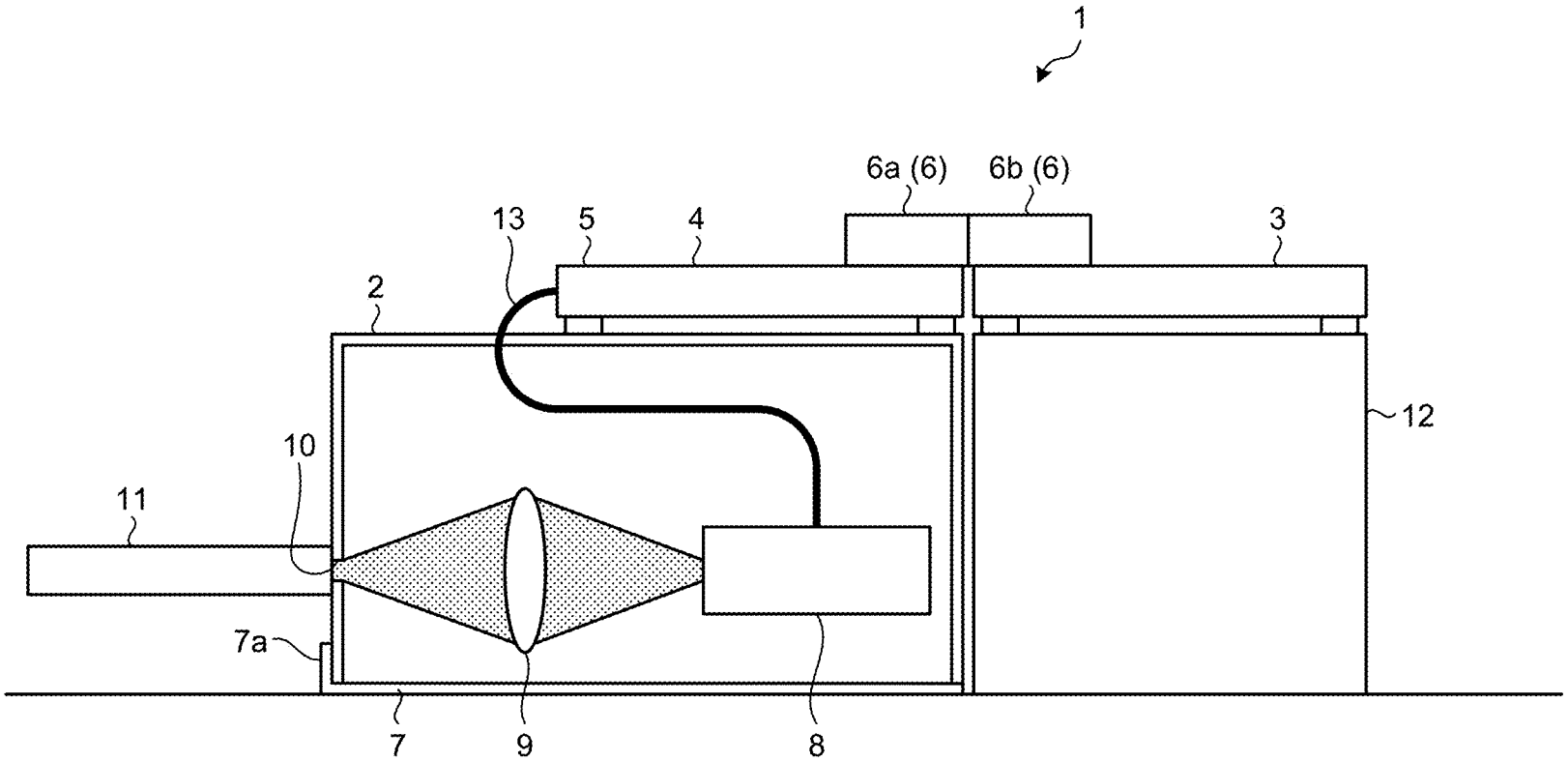
FIG. 2 is a cross-sectional view of the storage case of FIG. 1.

FIG. 1 is a perspective view illustrating a schematic configuration of a storage case 1 according to a first embodiment. FIG. 2 is a cross-sectional view of the storage case 1 of FIG. 1.

The storage case 1 includes a casing 2 that stores a light source 8 as a functional unit, a power supply board 3 that functions as a power supply unit supplying power to the functional unit, a drive module 5 that includes a drive board 4 to drive the functional unit, a board-to-board connector 6 that functions as a connection unit connecting the power supply board 3 and the drive module 5, and a mounting portion 7 that functions as a restriction member restricting movement of the casing 2.

The casing 2 has an opening bottom of rectangular shape and is mounted on the mounting portion 7. The casing 2 stores therein the light source 8 that emits laser light and a lens 9 that collects laser light emitted from the light source 8. An emission port 10 is defined in a side surface of the casing from which the laser light is emitted, and laser light emitted from the emission port 10 is input into a light guide 11. In the present first embodiment, the light source 8 that emits laser light is described as an example, but the light source 8 is not limited to this and may use light for an IR light source, special light source, white light, or the like.

The power supply board 3 includes a rigid board, is supported on a structure 12 having substantially the same height as the casing 2 mounted on the mounting portion 7, and is fixed to the structure 12. Furthermore, a board-to-board connector 6*b* as the connection unit for connection with the drive board 4 is attached to the power supply board 3, and the power supply board 3 is connected to an external power supply which is not illustrated. The structure 12 is arranged so as to make contact with a side surface of the casing 2, and the power supply board 3 is arranged on an upper surface of the structure 12 and along a side surface facing the casing 2.

The drive module 5 includes the drive board 4 that includes a rigid board, and a cable 13 that supplies power to the light source 8. The drive board 4 is arranged on an upper surface of the casing 2 and along a side surface facing the structure 12 and has an end portion to which a board-to-board connector 6*a* for connection with the power supply board 3 is attached.

The mounting portion 7 is formed of an insulating material and includes wall portions 7*a* that restrict movement of the casing 2. The wall portions 7*a* are provided on three sides of the mounting portion 7 except for a side facing the structure 12 and restrict forward and rearward and rightward and leftward movement of the casing 2 mounted on the mounting portion 7, together with the structure 12. In the present first embodiment, the wall portions 7*a* are arranged along outer peripheral side surfaces of the casing 2 but may be arranged along inner peripheral side surfaces of the casing 2.

Figure 3:
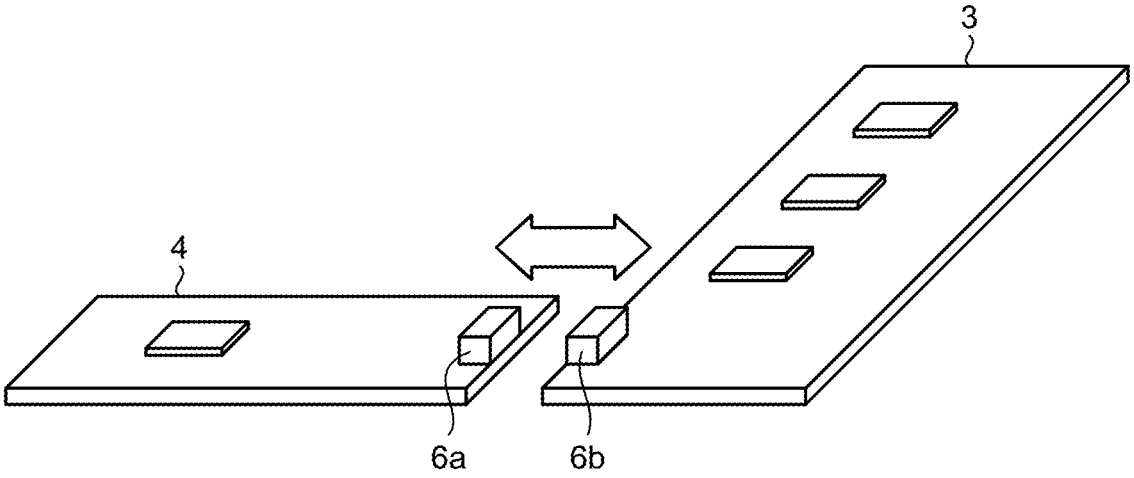
FIG. 3 is a diagram illustrating connection/disconnection of a connection unit of FIG. 1.

FIG. 3 is a diagram illustrating connection/disconnection of the board-to-board connectors 6*a* and 6*b* as the connection unit. The board-to-board connectors 6*a* and 6*b* have rigid connectors and moved in right-left directions in the drawing, for connection/disconnection. The power supply board 3 and the drive board 4, which have the rigid boards, are connected to each other by the board-to-board connectors 6*a* and 6*b* having the rigid connectors, and become a single plate without bending at the portion of the connectors.

Figure 4B:
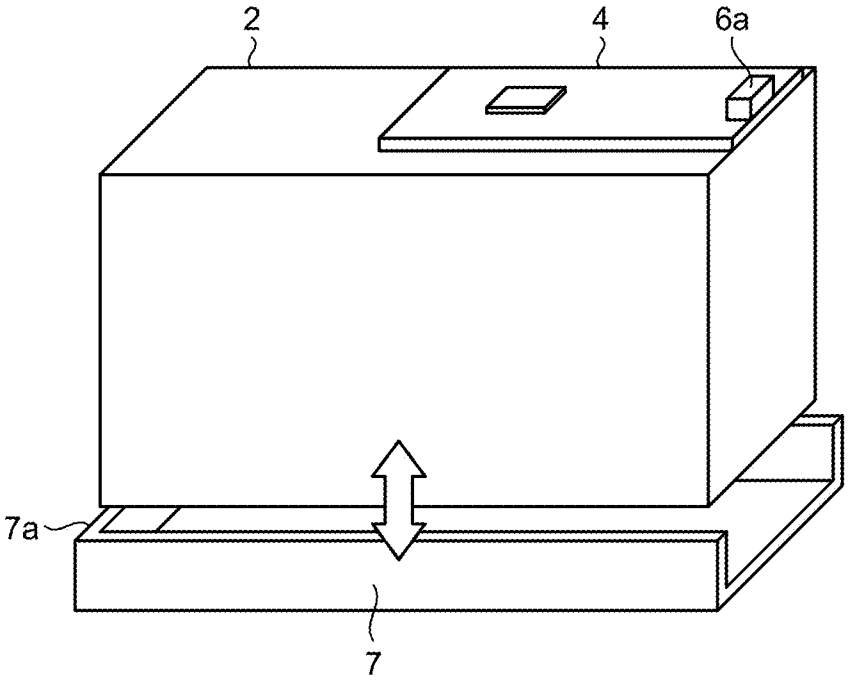
FIGS. 4A and 4B are diagrams illustrating removal of a casing of the storage case of FIG. 1.
Figure 4A:
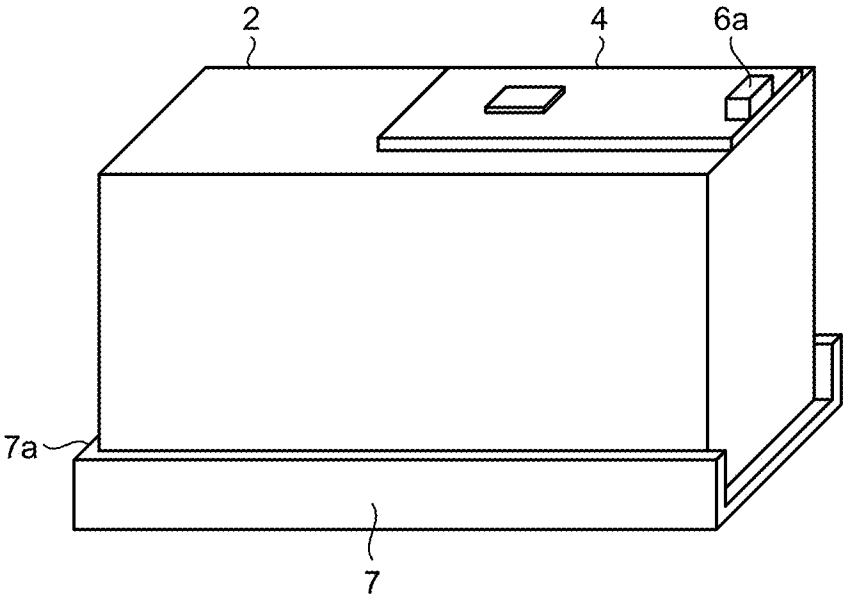
Figure 5:
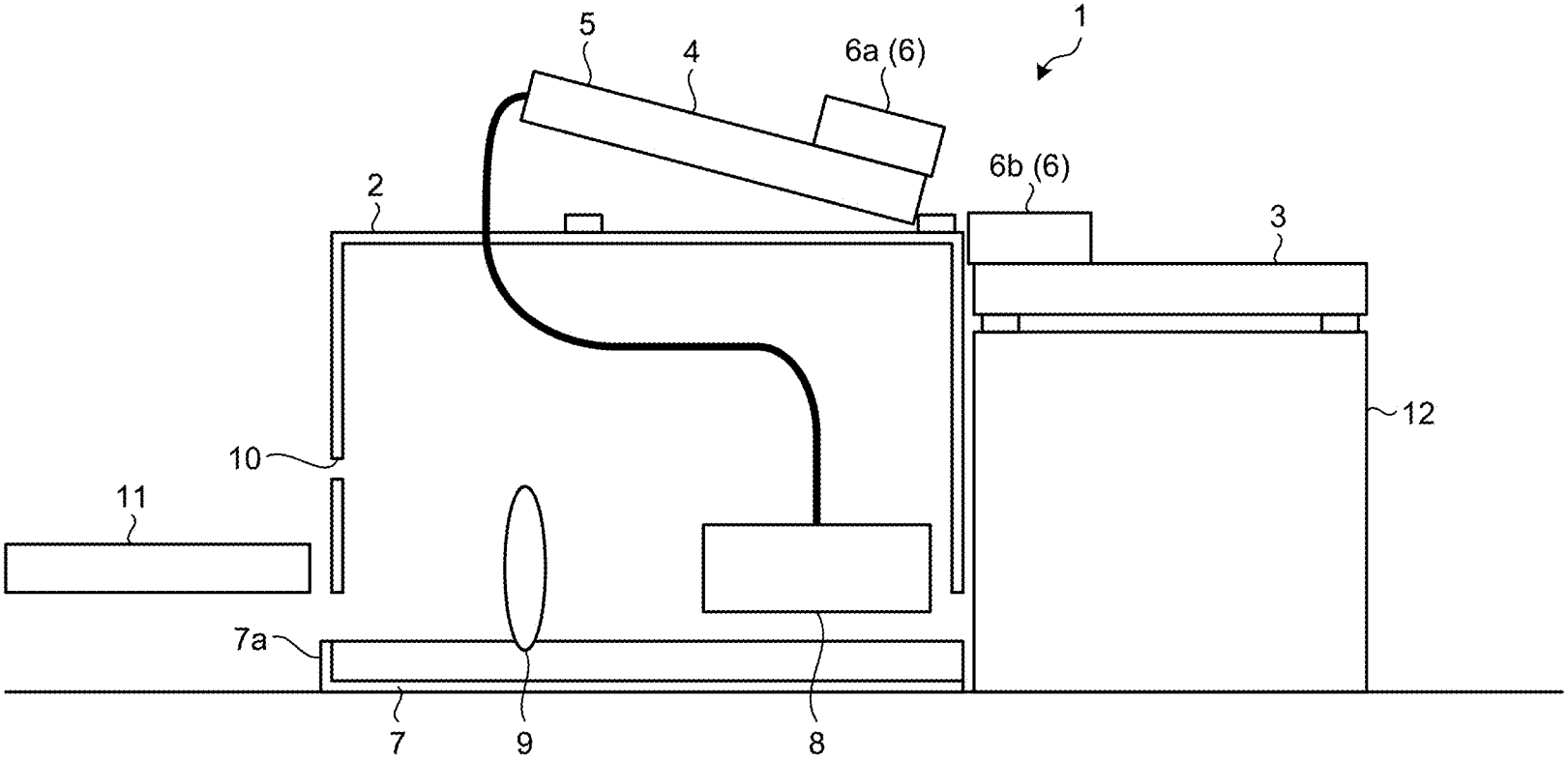
FIG. 5 is a cross-sectional view illustrating the removal of the casing of the storage case of FIG. 1.

FIGS. 4A and 4B are diagrams illustrating removal of the casing 2 of the storage case 1. In both FIGS. 4A and 4B, illustration of the power supply board 3 and the structure 12 is omitted. As illustrated in FIG. 4A, the casing 2 mounted on the mounting portion 7 is restricted in movement in three directions of forward, backward, and leftward directions in the drawing, by the wall portions 7*a*, and is restricted in rightward movement by the structure 12 arranged to be make contact with the mounting portion 7. Furthermore, when the drive board 4 is connected to the power supply board 3, the drive board 4 is connected by the board-to-board connectors 6*a* and 6*b* having the rigid connectors, and thereby the casing 2 is restricted in upward movement as well by the drive board 4, without bending at the portion of the connectors.

For replacement of the light source 8 in the casing 2, the drive board 4 is disconnected from the power supply board 3, and thereby it becomes possible to move the casing 2 in a removal direction, that is, upward direction, as illustrated in FIG. 4B.

In the present first embodiment, an connection/disconnection direction of the board-to-board connectors 6*a* and 6*b* is defined in the right-left directions orthogonal to the upward direction that is the removal direction of the casing 2, as illustrated in FIG. 3, the casing 2 is thereby not allowed to be removed until the board-to-board connectors 6*a* and 6*b* are disconnected from each other, and thus, the light source 8 is safely replaced while the light source 8 is turned off.

Note that in the first embodiment, the wall portions 7*a* of the mounting portion 7 are provided so as to make contact over the three side surfaces of the casing 2, but as long as the movement of the casing 2 may be restricted, the wall portions may be formed to make contact with only part of the side surfaces. Furthermore, the board-to-board connector 6 is used as the connection unit, but the connection unit is not limited to this and preferably employs any connector that is configured to electrically connect the drive board and the power supply board and is removable in a direction orthogonal to the removal direction of the casing 2.

Furthermore, in the first embodiment, as a best mode, the connection/disconnection direction of the board-to-board connectors 6*a* and 6*b* is defined as the right-left direction orthogonal to the upward direction that is the removal direction of the casing 2 as illustrated in FIG. 3, but the present disclosure is not limited to this.

In other words, in the present disclosure, the board-to-board connectors 6*a* and 6*b* are connected to apply a force for restricting the movement of the casing 2 at least in a direction in which the casing 2 is removed between the board-to-board connectors 6*a* and 6*b* while the board-to-board connectors 6*a* and 6*b* are connected, thus, obtaining effects equivalent to those of the first embodiment. For example, the board-to-board connectors 6*a* and 6*b* are configured to be removed in a direction different from the removal direction of the casing 2, and thus, achieving a configuration in which a force that restricts the movement of the casing 2 is applied in the direction in which the casing 2 is removed between the board-to-board connectors 6*a* and 6*b*.

Furthermore, the storage case 1 according to the first embodiment may store different types of light sources in addition to storing the same type of light source 8. In such a configuration, after disconnecting the board-to-board connectors 6*a* and 6*b*, the light source 8 and the drive module 5 are removed from the storage case 1, and another type of light source and drive module to be used are preferably connected to the power supply board 3 for use. The storage case 1 is configured to have a plurality of types of light sources and drive modules, and thereby changing the light sources or the like safely as necessary enables observation meeting the need.

Second Embodiment

Figure 6:
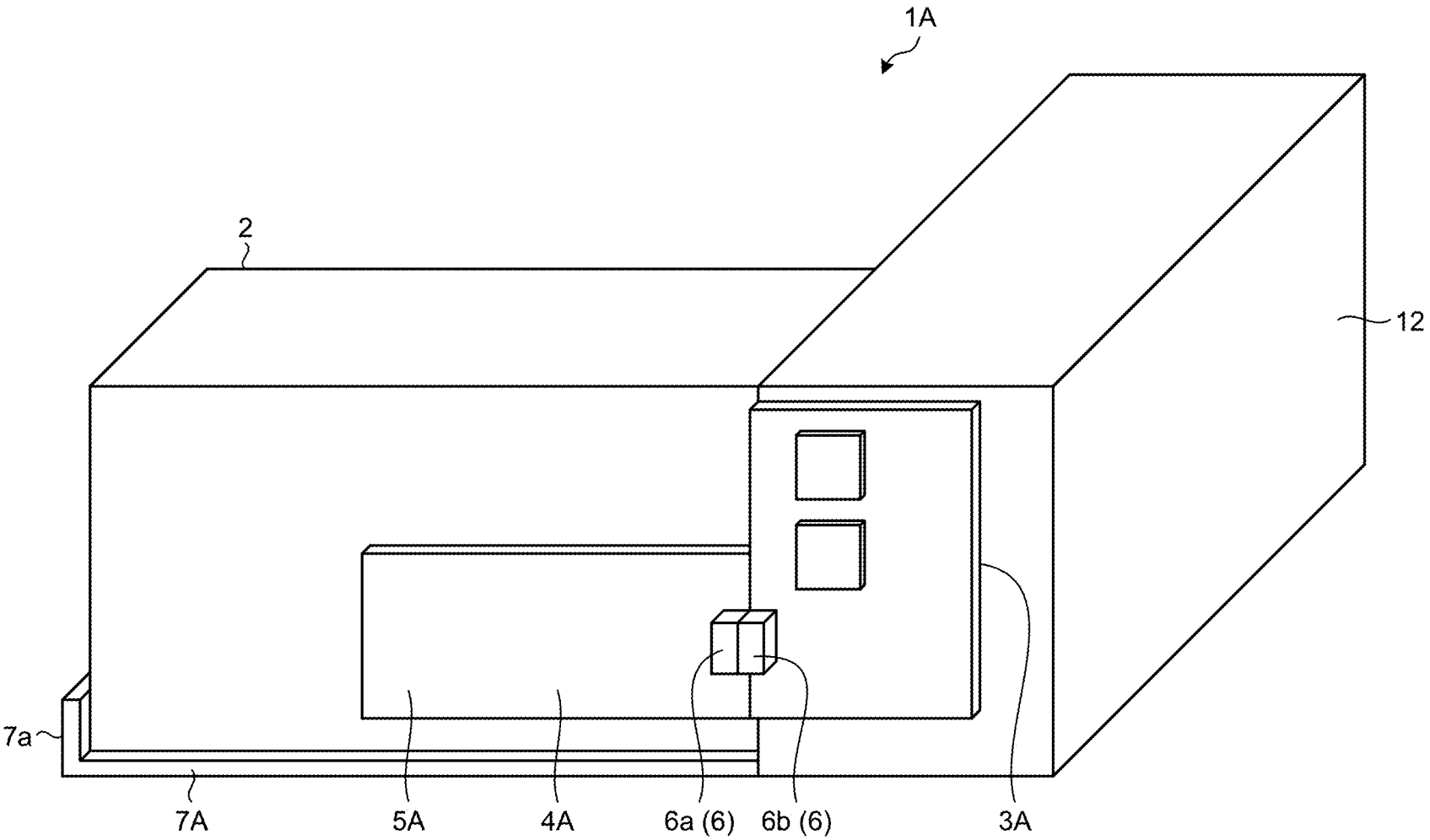
FIG. 6 is a perspective view illustrating a schematic configuration of a storage case according to a second embodiment.

FIG. 6 is a perspective view illustrating a schematic configuration of a storage case 1A according to a second embodiment. In the storage case 1A, a drive board 4A is arranged on a side surface of a casing 2.

In the storage case 1A, a power supply board 3A is fixed on a side surface of a structure 12. The structure 12 is arranged so as to make contact with a side surface of the casing 2, and the power supply board 3A is fixed on a side surface orthogonal to a surface making contact with the casing 2. The side surface of the structure 12 on which the power supply board 3A is arranged is flush with the side surface of the casing 2 on which the drive board 4A is arranged.

The drive board 4A is arranged on the side surface of the casing 2 and has an end portion to which a board-to-board connector 6*a* is attached, and the board-to-board connector 6*a* connects the drive board 4A to a board-to-board connector 6*b* that is attached to the power supply board.

A mounting portion 7A is formed of an insulating material, and wall portions 7*a* that restrict the movement of the casing 2 are provided on two sides of the right and left sides in the drawing. The wall portions 7*a*, together with the structure 12, restrict rightward, leftward, and rearward movement of the casing 2 mounted on the mounting portion 7A.

Figure 7B:
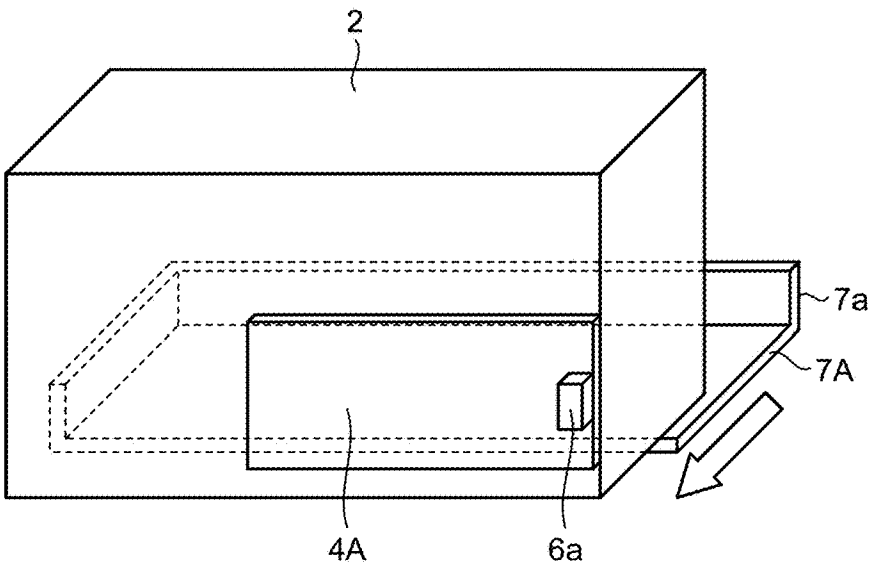
FIGS. 7A and 7B are diagrams illustrating removal of a casing of the storage case of FIG. 6.
Figure 7A:
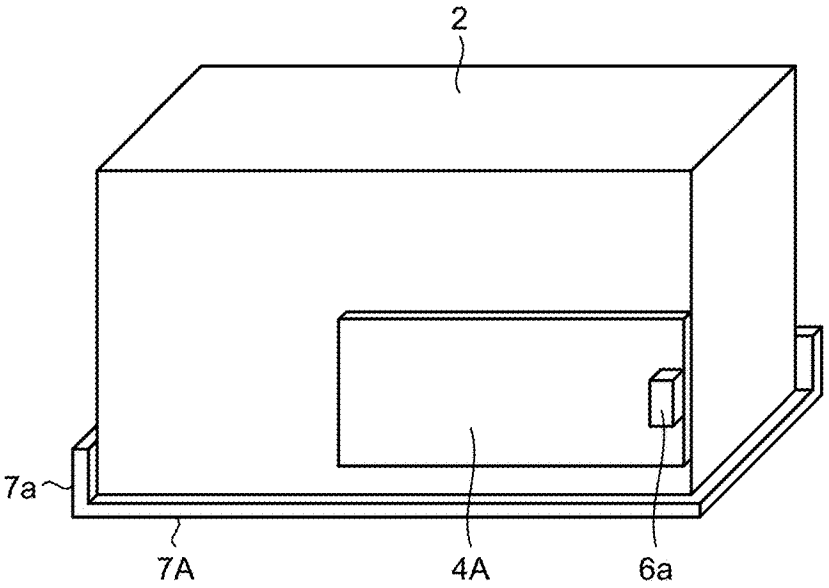

FIGS. 7A and 7B are diagrams illustrating removal of the casing 2 of the storage case 1A. In both FIGS. 7A and 7B, illustration of the power supply board 3A and the structure 12 is omitted. As illustrated in FIG. 7A, the casing 2 mounted on the mounting portion 7A is restricted in movement in two directions of rearward and leftward directions in the drawing, by the wall portions 7*a*, and is restricted in rightward movement by the structure 12 arranged so as to make contact with the mounting portion 7A. Furthermore, when the drive board 4A is connected to the power supply board 3A, the drive board 4A is connected by the board-to-board connectors 6*a* and 6*b* that have rigid connectors, and thereby the casing 2 is restricted in forward movement as well by the drive board 4A, without bending at the portion of the connectors.

In order to replace a light source in the casing 2, the drive board 4A is disconnected from the power supply board 3A, and thereby it becomes possible to move the casing 2 in a removal direction, that is, forward direction, as illustrated in FIG. 7B.

In the present second embodiment, an connection/disconnection direction of the board-to-board connectors 6*a* and 6*b* is defined in the right-left directions orthogonal to the forward direction that is the removal direction of the casing 2, the casing 2 is thereby not allowed to be removed until the board-to-board connectors 6*a* and 6*b* are disconnected from each other, and thus, the light source 8 is safely replaced while the light source 8 is turned off.

Note that, in the present second embodiment as well, the connection/disconnection direction of the board-to-board connectors 6*a* and 6*b* is not limited to a direction orthogonal to the removal direction of the casing 2, and as described in the first embodiment, the board-to-board connectors 6*a* and 6*b* configured to be removed in a direction different from the removal direction of the casing 2 enables the configuration to apply a force that restricts the movement of the casing 2 in the removal direction of the casing 2, between the board-to-board connectors 6*a* and 6*b*, thus, obtaining effects equivalent to those of the second embodiment.

Note that the present disclosure may also have the following configurations.

(1) A storage case including:

a casing having an opening bottom and configured to internally store a functional unit electrically connected to perform a function;

a power supply configured to supply power to the functional unit;

a drive module including a drive board arranged on an upper surface or side surface of the casing and configured to drive the functional unit;

a connector configured to electrically connect the power supply and the drive module; and a restriction member configured to restrict movement of the casing, wherein the drive board is arranged on a surface in a removal direction of the casing, and a connection/disconnection direction of the connector is different from the removal direction of the casing.

(2) The storage case according to (1), wherein the restriction member is a mounting portion configured to mount the casing thereon, the mounting portion including a wall portion restricting movement of the casing in a direction other than a predetermined direction including the removal direction.

(3) The storage case according to (1) or (2), wherein the functional unit is a light source.

(4) The storage case according to any one of (1) to (3), wherein the power supply unit is a board supported by a structure, and the connector is a board-to-board connector.

(5) The storage case according to any one of (1) to (4), wherein the functional unit includes a plurality of types of light sources, and the plurality of types of light sources are changed together with drive modules corresponding to the plurality of types of light sources and connected to the power supply.

(6) The storage case according to any one of (1) to (5), wherein the connection/disconnection direction of the connector is a direction orthogonal to the removal direction of the casing.

The storage case according to the present disclosure is configured so that removal of the casing is restricted by the drive module connected to the power supply unit via the connection unit, and the casing is allowed to be removed only when the drive module is disconnected from the power supply unit, enabling safe replacement of the functional unit.

Although the disclosure has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A storage case comprising:

a casing having an opening bottom and configured to internally store a functional unit electrically connected to perform a function;

a power supply configured to supply power to the functional unit;

a drive module including a drive board arranged on an upper surface or side surface of the casing and configured to drive the functional unit;

a connector configured to electrically connect the power supply and the drive module; and a restriction member configured to restrict movement of the casing, wherein the drive board is arranged on a surface in a removal direction of the casing, and a connection/disconnection direction of the connector is different from the removal direction of the casing.

2. The storage case according to claim 1, wherein the restriction member is a mounting portion configured to mount the casing thereon, the mounting portion including a wall portion restricting movement of the casing in a direction other than a predetermined direction including the removal direction.

3. The storage case according to claim 2, wherein the mounting portion is an insulating mounting portion.

4. The storage case according to claim 2, wherein the wall portion includes wall portions on at least two sides of the mounting portion.

5. The storage case according to claim 4, wherein the mounting portion includes wall portions on three sides thereof.

6. The storage case according to claim 5, wherein the connector includes a first connector on the drive module and a second connector on the power supply, the storage case further including a power supply mount that mounts the power supply such that the second connector faces and contacts the first connector when the casing is on the mounting portion, and the wall portions on three sides of the mounting portion and the power supply mount together restrict movement of the casing on the mounting portion.

7. The storage case according to claim 2, wherein the wall portion extends along an entirety of a corresponding side of the mounting portion.

8. The storage case according to claim 2, wherein the connector includes a first connector on the drive module and a second connector on the power supply, the storage case further including a power supply mount that mounts the power supply such that the second connector faces and contacts the first connector when the casing is on the mounting portion.

9. The storage case according to claim 1, wherein the functional unit is a light source.

10. The storage case according to claim 9, further comprising a lens in the casing, the lens to collect light output from the light source.

11. The storage case according to claim 9, wherein the light source is one of a laser, an infrared light source, a white light source, or a special light source.

12. The storage case according to claim 9, wherein a first type of light source and a first drive module that drives the first type of light source are swappable for a second type of light source and a second drive module that drives the second type of light source.

13. The storage case according to claim 1, wherein the power supply is a board supported by a structure, and the connector is a board-to-board connector.

14. The storage case according to claim 1, wherein the functional unit includes a plurality of types of light sources, and the plurality of types of light sources are changed together with drive modules corresponding to the plurality of types of light sources and connected to the power supply.

15. The storage case according to claim 1, wherein the connection/disconnection direction of the connector is a direction orthogonal to the removal direction of the casing.

16. The storage case according to claim 1, wherein the functional unit includes a plurality of types of light sources.

17. The storage case according to claim 1, wherein the connector includes a first connector on the drive module and a second connector on the power supply, the storage case further including a power supply mount that mounts the power supply such that the second connector faces and contacts the first connector when the casing is coupled to the restriction portion.

18. The storage case according to claim 17, wherein the removal direction of the casing is a vertical direction and a connection/disconnection direction of the connector is a horizontal direction.

19. The storage case according to claim 1, wherein the removal direction of the casing and the connection/disconnection direction are orthogonal.

* * * * *